US006796063B1

(12) United States Patent
Bryant

(10) Patent No.: US 6,796,063 B1
(45) Date of Patent: Sep. 28, 2004

(54) LUGGAGE RACK FLAG MOUNT

(76) Inventor: Robert K. Bryant, 61 Turner Loop Rd., Three Way, TN (US) 38343

( * ) Notice: Subject to any disclaimer, the term of this patent is extended or adjusted under 35 U.S.C. 154(b) by 0 days.

(21) Appl. No.: 10/335,170

(22) Filed: Dec. 31, 2002

(51) Int. Cl.[7] ..... G09F 17/00

(52) U.S. Cl. ..... 40/592; 40/218; 40/666; 116/51

(58) Field of Search ..... 40/632.02, 652, 40/653, 654, 658, 647, 648, 666, 660, 661.03, 661.06, 661.07, 661.12, 662, 667, 672, 218, 591, 592, 412, 413, 492; 24/272, 16 PB; 116/28 R, 51; 248/72, 70, 74.4

(56) References Cited

U.S. PATENT DOCUMENTS 1,983,670 A * 12/1934 Knight ..... 248/228.3
2,302,672 A * 11/1942 Buckley ..... 416/83
3,241,255 A * 3/1966 Hanley ..... 40/662
3,757,031 A * 9/1973 Izraeli ..... 174/138 F
4,052,697 A * 10/1977 Daifotes ..... 340/472
4,118,838 A * 10/1978 Schiefer et al. ..... 24/115 R
4,935,992 A * 6/1990 Due ..... 24/16 R
5,657,914 A * 8/1997 Stapleton ..... 224/319
5,769,292 A * 6/1998 Cucheran et al. ..... 224/324
5,775,653 A * 7/1998 Horney et al. ..... 248/230.8
6,062,160 A * 5/2000 Delcambre ..... 116/28 R
6,126,122 A * 10/2000 Ismert ..... 248/74.1
6,161,803 A * 12/2000 Daoud ..... 248/68.1
6,516,498 B2 * 2/2003 LaCoy et al. ..... 24/16 R

* cited by examiner

*Primary Examiner*—Mark T. Le

(57) ABSTRACT

The luggage rack flag mount is a device designed for mounting accessories to the cross bar of luggage racks. This mounting mechanism consists of a smooth adjustable clamp that may be tightened on a crossbar by applying simple squeezing pressure on either end of the clamp. The clamp comprises hooks which are connected by a cross member. One of these hooks is inserted into a groove in the cross member and teeth on the surface of the groove and this hook interlock to hold them together. The present invention also consists of a mount attached to the upper surface of the clamp by a hinge. A flagpole may be secured to this mount and the wind resistance against the flag caused by the motion of the vehicle will cause the flag to rise. A block is secured to the clamp adjacent to the hinge so that the flagpole will remain upright when the vehicle is moving. When the vehicle stops moving the weight of the flag will cause the flagpole to fall to a resting position atop the clamp.

18 Claims, 2 Drawing Sheets

LUGGAGE RACK FLAG MOUNT

BACKGROUND OF THE INVENTION

1. Field of the Invention

The present invention relates to mountable decorative accessories for motor vehicles that are equipped with a luggage rack.

2. Description of the Prior Art

Flags have become one of the most popular automobile accessories on the market. Flags representing everything from sports teams to national allegiance have been produced. The most common mounting designs are to attach these flags to the hoods of cars or the edge of windows. The mounting of flags on hoods is dangerous since it may obstruct the drivers view. It also limits visibility to the side of the vehicle where the flag is located. The designs for windows have several drawbacks. They may prevent the opening of windows where the flag is mounted. They also are mounted close to the body of the vehicle risking damage to the surface.

In addition to displaying flags for decorative purposes, they may also serve a function. If they are displayed high enough, the vehicle owner will be assisted in identifying his vehicle in a crowded parking lot. It would therefore be desirable to mount the flag in as high a position as possible in order to increase the flag's visibility. An extremely popular feature on vehicles is a luggage rack. These generally consist of rails mounted on the top of the vehicle with cross members attached at either end to these rails. The rails hold these cross members remote from the vehicle body. Thus if a flag is mounted to the cross members it would be at the highest, most visible point of the vehicle. Furthermore it would be entirely out of the view of the driver, eliminating in safety hazard. The gap between the cross members and the body of the vehicle would prevent any body damage. The flag should be mounted in such a way that it will be erect when the vehicle is being driven, but will lay flat when the vehicle enters a garage so that it will clear the door and roof.

U.S. Pat. No. 3,540406 to Carl J. Dexter is a design for a flag that may be mounted to the roof of a vehicle. The drawback for this mounting system is that it is mounted directly to the roof of the vehicle. This greatly increases the risk of damage to the paint on the surface. The Dexter '406 patent does have a mechanism for retracting the flag, but this design incorporates no base upon which the flag may rest when the flag is retracted. Thus the pole will vibrate and scrape the surface of the vehicle.

U.S. Pat. No. 4,590,883 to Ivan V. Steed and Jeffrey I. Gill, U.S. Pat. No. 5,233,938 to Abraham Lalo, and U.S. Pat. No. 6,010,107 to Abraham Goldfarb are all examples of devices that mount a flag to the window of a vehicle. All of these designs employ a mount that is braced by a hooking mechanism over the window. These designs have a variety of drawbacks. Typically the driver of a car will not want to lower the window while the flag is mounted since it will produce loud noise and may be a dangerous distraction. The mounting of flags in this fashion also risks damage to the surface of the vehicle. None of these designs employ an automatic mechanism for lowering the flag when entering garages.

The device disclosed in U.S. Pat. No. 6,085,687 to Morgan Chester is for mounting flags to luggage racks. It however uses a bolt tightened clamping mechanism for attaching the flag base to the cross member of the luggage rack while the present invention uses an easier clip-on mechanism. This bolt tightened design of the Chester '687 patent has many sharp edges while the present invention forms one smooth unit. Thus the risk of damage to the vehicle is reduced. There is no element disclosed in the Chester design that would allow for the lowering of the flag without entirely removing the flag from the vehicle. This makes the Chester design far less practical since vehicles commonly must enter garages and tunnels that would have clearances too low for a flag mounted on the roof to pass.

U.S. Pat. No. Des. 359, 924 to Victor N. Grumbeck discloses a flag mounted on a pole that may be telescopically raised or lowered. The design is for a device that is to be mounted to a window and thus has the same drawbacks of the patents discussed earlier. While the telescopic pole will allow the user to lower the flag it will still protrude upward and create an obstruction.

Therefore a need exists for a novel and enhanced method for mounting a flag to the cross member of a luggage rack while providing a convenient retraction mechanism to lower the flag when entering a garage. This device should be reusable and durable. This device should create no damage to the vehicle. In this respect, the luggage rack flag mount according to the present invention substantially departs from the conventional concepts and designs of the prior art, and in doing so provides an apparatus primarily developed for the purpose of mounting retractable flags to the cross members of luggage racks.

SUMMARY OF THE INVENTION

In view of the foregoing disadvantages inherent in the known types of mechanisms for mounting flags on automobiles now present in the prior art, the present invention provides an improved combination of convenience and utility, and overcomes the abovementioned disadvantages and drawbacks of the prior art. As such, the general purpose of the present invention, which will be described subsequently in greater detail, is to provide a new and improved luggage rack flag mount which has all of the advantages of the prior art mentioned heretofore and many novel features that result in a luggage rack flag mount which is not anticipated, rendered obvious, suggested, or even implied by the prior art, either alone or in combination thereof.

In furtherance of this objective, the luggage rack flag mount comprises a clamp that comprises a pair of U-shaped hooks. The distance between these hooks may be adjusted so that the hooks will rest snuggly about the cross member of a luggage rack. Attached to said clamp is a mount which comprises a brace. Seated within said brace is a flag pole to which may be attached a flag.

There has been outlined, rather broadly, the more important features of the invention in order that the detailed description thereof that follows may be better understood and in order that the present contribution to the art may be better appreciated.

The present invention may in addition comprise a hinge attached to said clamp and said mount so that said flag pole may rest atop said clamp in a retracted position. Said flag may be raised to a right angle with said clamp when in an upright position.

An additional aspect of present invention is that the distance between said U-shaped hooks is adjusted by a saw tooth interlocking joint wherein one of said u-shaped hooks comprises a series of triangular teeth that may be inserted within a groove in the upper portion of said clamp. Said groove further comprises a series of triangular teeth that interlock with said teeth on said first u-shaped member. Thus the user may insert said u-shaped member until both of said u-shaped members are snuggly clamped on said luggage rack cross member and the interlocking teeth will maintain the appropriate distance.

Said brace for said flagpole may comprise a plurality of rectangular members, the middle of which are curved to match the diameter of said flagpole. The ends of said members are attached to said mount and said flagpole is held between said curved portion and the surface of said mount.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved luggage rack car mount that has all of the advantages of the prior art and none of the disadvantages.

It is another object of the present invention to provide a new and improved luggage rack car mount that may be easily and efficiently manufactured and marketed.

An even further object of the present invention is to provide a new and improved luggage rack car mount that has a low cost of manufacture with regard to both materials and labor, and which accordingly is then susceptible of low prices of sale to the consuming public, thereby making such luggage rack car mount economically available to the buying public.

Still another object of the present invention is to provide a new replaceable luggage rack car mount that provides in the apparatuses and methods of the prior art some of the advantages thereof, while simultaneously overcoming some of the disadvantages normally associated therewith.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
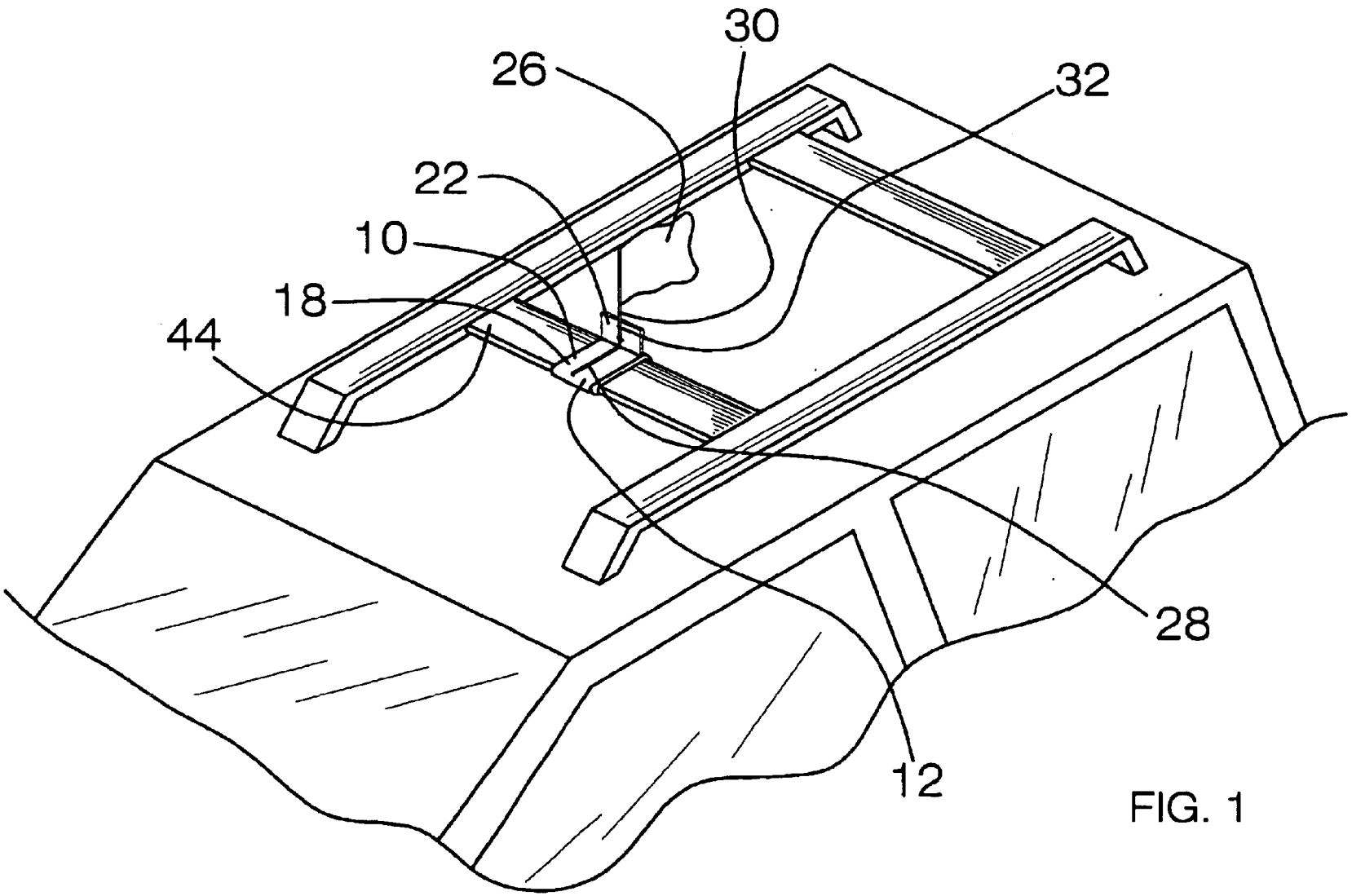
FIG. 1 is a top perspective view of the preferred embodiment of the luggage rack car mount of the present invention.
Figure 3:
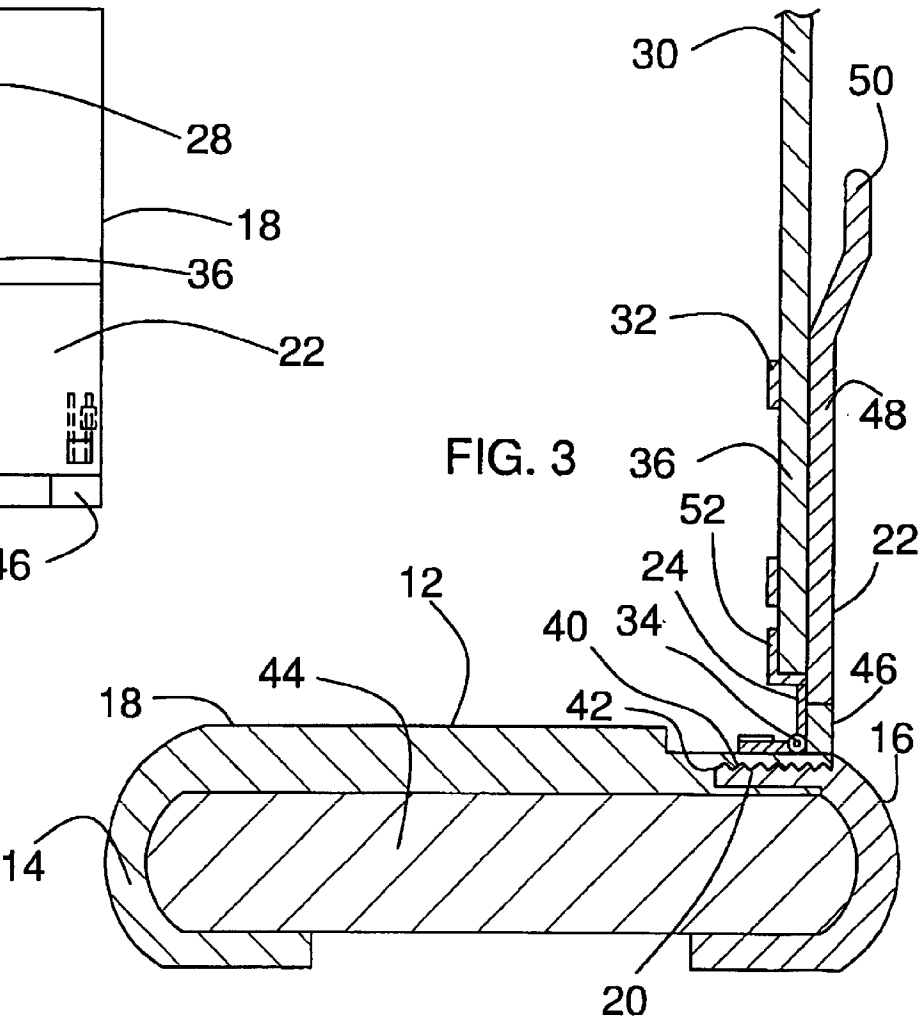
FIG. 3 is a side sectional view of luggage rack car mount of the present invention.
Figure 2:
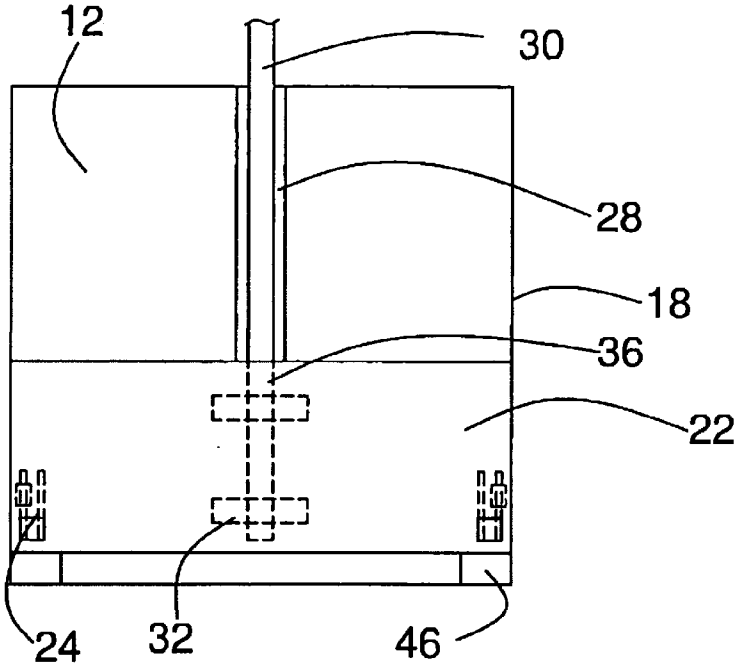
FIG. 2 is a top sectional view of the luggage rack car mount of the present invention in a folded position.

Referring now to the drawings, and particularly to FIGS. 1–3, a preferred embodiment of the luggage rack flag mount of the present invention is shown and generally designated by the reference numeral 10.

In FIG. 1, a view of a fully mounted luggage rack car mount 10 is shown. The present invention comprises a clamp 12. Said clamp 12 comprises a first 14 and a second U-shaped hook 16. Said U-shaped hooks are oriented so that they oppose one another. The upper prong of the first of said U-shaped hooks 14 is attached to a long rectangular member 18 that constitutes the top of said clamp 12. The upper prong of said second U-shaped hook 16 may be inserted into a groove 20 defined in said rectangular member 18, allowing the user to press said second hook towards said first hook 14 until said hooks firmly grasp a cross member of a luggage rack.

Attached to the top surface of said clamp 12 is a rectangular flag mount 22. Said flag mount 22 may be attached to said clamp 12 by a hinge 24 so that a flag 26 may be folded upon the surface of said clamp 12. Said clamp 12 may comprise a groove 28 within which a flagpole 30 may rest when it is in a folded position. When the vehicle is stationary, the weight of said flagpole 30 will cause said hinge 24 to collapse and said flag 26 will rest folded. When said vehicle begins to move, the wind resistance of said flag 26 will cause it to be raised into an upright position. Said flagpole 30 is held to said flag mount 22 by a pair of rectangular braces 32. Said braces 32 comprise a curved middle portion so that when said braces are attached to said mount 22, said flag pole 30 may be seated in the space between said curved portions and said mount 22. Said flagpole 30 and said mount 22 may be made of plastic or metal and said flag 26 may be made of any resilient material such as canvas or a polyester blend.

In FIG. 2 is a sectional view of the luggage rack flag mount 10 in a folded position. A first and a second hinge 24 attach said rectangular mount to said clamp 12. Said hinges 24 are mounted to the lower surface of said flag mount 22 and the upper surface of said clamp 12 and comprise an axle 34 about which said mount may be rotated. Metal would be the ideal material for said hinges 24. A pair of rectangular braces 32 is attached to the surface of said flag mount 22. Said braces 32 comprise a curved portion and may be made of metal or plastic. Said flagpole 30 is held in the gap created between said braces 32 and said flag mount 22. Said flagpole 30 comprises a cylindrical bar 36. Said clamp 12 comprises a curved shaped groove 28 in its upper surface wherein said flagpole 30 may be seated when it is in a folded position.

In FIG. 3 a side sectional view of the luggage rack flag mount 10 is shown in an upright position. Said clamp 12 comprises a first 14 and a second 16 U-shaped hook that are oriented so that they oppose one another. Attached to the upper prong of said first U-shaped hook 14 is said rectangular member 18. Said rectangular member 18 comprises a groove 20. Said rectangular member 18 further comprises a series of triangular teeth 40 along the inner surface of said groove. The upper prong of said second U-shaped hook comprises a series of triangular teeth 42 and is sized to fit within said groove 20 of said rectangular member 18. Said rectangular member 18 is made of a pliable material. When said upper prong of said second U-shaped hook 16 is inserted within said groove 20, The lateral force caused by the angular surfaces of said triangular teeth will cause the top portion of said rectangular member 18 to bend upward allowing said teeth of said second U-shaped hook 42 to pass said teeth of said rectangular member 40. The user will press said second U-shaped hook 16 until it, along with said first U-shaped hook 14, are snuggly clamped on said cross member 44. The interlocking teeth of said second U-shaped hook and said rectangular member will maintain the grip of said clamp 12.

Mounted to the upper surface of said rectangular member 18 is a hinge 24. Said hinge 24 comprises a pair of rectangular members one of which is attached to said rectangular member of said clamp 12 and the other of which is attached to said flag mount 22. A barrel is attached to each member and a bar passes through said barrels to act as an axle. Attached to the end of said rectangular clamp member 18 is a resting block 46. Attached to said hinge 24 is said flag mount 22. Said mount comprises a rectangular member 48 with a slanted flange 50 at the top. Said flagpole 30 is seated on said mount 22 by a plurality of braces 32. In this view there are two rectangular braces 32 that comprise a curved middle portion. Said flagpole 30 is held between said flag mount 22 and said curved portions of said braces 32. In FIG. 3 a third seated brace 52 is also shown. Said brace 52 comprises a barrel with one closed end and one open end. Said third brace 52 is mounted with said open end upward so that said flag pole 30 may rest within said barrel. When said flag mount 22 is raised in an upward position its lower surface rests upon said resting block 46.

While a preferred embodiment of the luggage rack 10 has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specification are intended to be encompassed by the present invention. For example, any suitable flexible material may be used instead of the plastics that have been described. And although the attaching of flags has been described, there are slight variations, such as shape and size that would make the invention appropriate for other decorative items.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for mounting accessories on automobiles comprising:

a clamp attachable to a standard luggage rack crossbar comprising a rectangular member and extending from said rectangular member a hook, a second hook removably engaged with said rectangular member and held so that said first and said second hook straddle and hug the forward and rearward sides of said crossbar;

an arm pivotably secured to the upper surface of said rectangular member; and a decorative accessory attached to said arm, wherein the weight of said decorative accessory and said arm maintains said arm in a horizontal position unless said automobile is in motion, in which case the drag of said decorative accessory and said arm causes said arm to pivot into a vertical position.

2. The system for mounting accessories on automobiles of claim 1 further comprising a socket mechanism whereby said arm may be removably secured to said upper surface of said rectangular member.

3. The system for mounting accessories on automobiles of claim 1 further comprising a hinge whereby said arm may be secured to said upper surface of said rectangular member by said hinge.

4. The clamp element of claim 1 wherein said rectangular member comprises a flexible material and is formed to define a groove wherein the upper surface of said groove comprises triangular teeth and wherein said second hook comprises an upper prong comprising triangular teeth and wherein said second hook is removably engaged with said rectangular member by inserting said upper prong into said groove until said hooks are separated by a distance wherein they firmly hug said crossbar and are held in place due to the frictional resistance of said triangular teeth.

5. The clamp element of claim 1 wherein said rectangular member is formed to define a groove shaped to receive said arm.

6. The system for mounting accessories on automobiles of claim 1 further comprising a mount attached to said rectangular member and a plurality of braces attached to said mount that secure said arm to said mount.

7. A system for mounting accessories to automobiles comprising:

a clamp;

a hinge attached to the upper surface of said clamp;

a mount attached to said hinge; and a decorative accessory attached to said mount, wherein the weight of said decorative accessory maintains said mount in a horizontal position unless said automobile is in motion, in which case the drag of said decorative accessory causes said mount to pivot about said hinge into a vertical position.

8. The system for mounting accessories on automobiles of claim 7 comprising a plurality of braces attached to said mount that may secure said decorative accessory.

9. The system for mounting accessories on automobiles of claim 7 further comprising a socket mechanism attached to said mount whereby said decorative accessory may be removably secured to said mount.

10. The clamp element of claim 7 wherein said clamp comprises a rectangular member that is formed to define a groove shaped to receive said decorative accessory.

11. The clamp element of claim 7 comprising a rectangular member and extending from said rectangular member a hook, and wherein said clamp further comprises a second hook removably engaged with said rectangular member and held so that said first and said second hook straddle and hug the forward and rearward sides of said crossbar.

12. The clamp element of claim 7 comprising a rectangular member and extending from said rectangular member a hook, and wherein said clamp further comprises a second hook removably engaged with said rectangular member and held so that said first and said second hook straddle and hug the forward and rearward sides of said crossbar and wherein said rectangular member comprises a flexible material and is formed to define a groove wherein the upper surface of said groove comprises triangular teeth and wherein said second hook comprises an upper prong comprising triangular teeth and wherein said second hook is removably engaged with said rectangular member by inserting said upper prong into said groove until said hooks are separated by a distance wherein they firmly hug said crossbar and are held in place due to the frictional resistance of said triangular teeth.

13. The system for mounting accessories on automobiles of claim 7 comprising a rectangular base attached to the upper surface of said clamp adjacent to said hinge, wherein said rectangular base prohibits said hinge from opening more than 90°.

14. A system for mounting accessories to automobiles comprising:

a clamp attachable to a standard luggage rack crossbar comprising a rectangular member and extending from said rectangular member a hook, a second hook removably engaged with said rectangular member and held so that said fist and said second hook straddle and hug the forward and rearward sides of said crossbar;

a hinge attached to the upper surface of said rectangular member of said clamp;

a mount attached to said hinge;

a rectangular base attached to the upper surface of said clamp adjacent to said hinge, wherein said rectangular base prohibits said hinge from opening more than 90°;

a flagpole having opposing ends with one end attached to said mount; and a flag attached to said opposing end of said mount, wherein the weight of said flagpole and said flag maintains said mount in a horizontal position unless said automobile is in motion, in which case the drag of said flagpole and said flag causes said mount to pivot about said hinge into a vertical position.

15. The system for mounting accessories on automobiles of claim 14 comprising a plurality of braces attached to said mount that may secure said flagpole.

16. The system for mounting accessories on automobiles of claim 14 further comprising a socket mechanism attached to said mount whereby said flagpole may be removably secured to said mount.

17. The clamp element of claim 14 wherein said rectangular member is formed to define a groove shaped to receive said flagpole.

18. The clamp element of claim 14 wherein said rectangular member comprises a flexible material and is formed to define a groove wherein the upper surface of said groove comprises triangular teeth and wherein said second hook comprises an upper prong comprising triangular teeth and wherein said second hook is removably engaged with said rectangular member by inserting said upper prong into said groove until said hooks are separated by a distance wherein they firmly hug said crossbar and are held in place due to the frictional resistance of said triangular teeth.

* * * * *